United States Patent [19]

Miller

[11] Patent Number: 4,510,954

[45] Date of Patent: Apr. 16, 1985

[54] APPARATUS AND METHOD FOR AUTOMATICALLY REMOVING FINGERNAIL POLISH

[76] Inventor: Richard J. Miller, 19009 Laurel Park Rd. #460, Dominguez Hills, Calif. 90220

[21] Appl. No.: 377,381

[22] Filed: May 12, 1982

[51] Int. Cl.[3] ..... A45D 29/20

[52] U.S. Cl. ..... 132/75; 132/73.5

[58] Field of Search ..... 132/73.5, 73.6, 74.5, 132/75, 73; 15/23, 210, 21 R; 401/122, 129, 126

[56] References Cited

U.S. PATENT DOCUMENTS

| | | | |
|---|---|---|---|
| 1,366,306 | 1/1921 | Wick | 15/21 R |
| 2,436,291 | 2/1948 | Daniel | 401/122 X |
| 2,629,124 | 2/1953 | Merritt | 15/140.2 |
| 2,877,810 | 3/1959 | Zackheim | 141/24 |
| 3,067,443 | 12/1962 | Romens et al. | 15/21 R |
| 3,258,018 | 6/1966 | Tinsley | 132/88.5 |
| 3,563,252 | 2/1971 | Spohr et al. | 132/73.6 |
| 3,754,556 | 10/1973 | Watkins | 128/52 |
| 4,130,908 | 12/1978 | Alcamo | 15/21 R |
| 4,180,884 | 1/1980 | Hess et al. | 15/21 R |
| 4,319,596 | 3/1982 | Jackson | 132/73.6 |

FOREIGN PATENT DOCUMENTS

| | | |
|---|---|---|
| 2263722 | 3/1974 | France . |
| 526428 | 3/1955 | Italy . |

*Primary Examiner*—Gregory E. McNeill

*Attorney, Agent, or Firm*—Wolf, Greenfield & Sacks

[57] ABSTRACT

A device and method for automatically removing fingernail polish from one or more fingernails at a time is described. In a preferred embodiment, the device has a rotating brush with soft bristles contained in a compartment having fingernail polish removing fluid. The fingers from which fingernail polish is to be removed are placed through an opening near the top of the compartment so that the fingernails press against the bristles of the brush. The brush, rotated by an electric motor, brushes the fingernail polish removing fluid against the fingernails and removes the fingernail polish. Fluid is kept within the compartment by means of a flexible diaphragm over the opening having slits therein for the fingers.

6 Claims, 8 Drawing Figures

FIG. 5
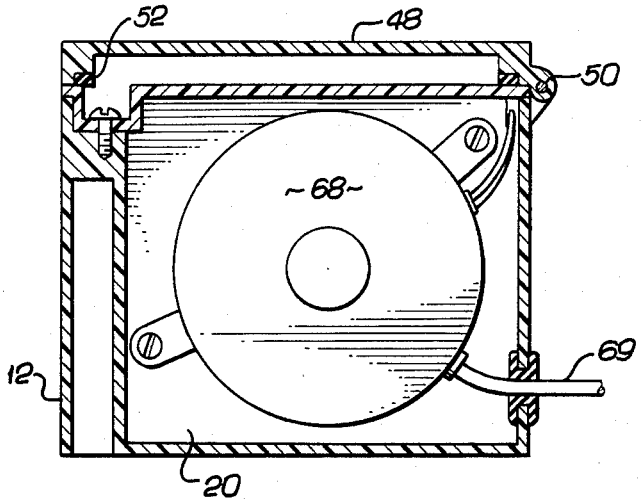
FIG. 6
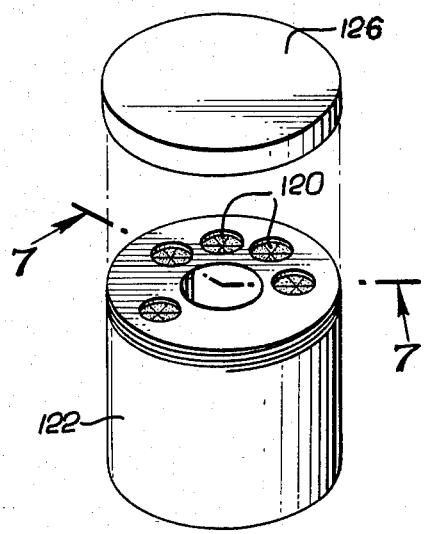
FIG. 7
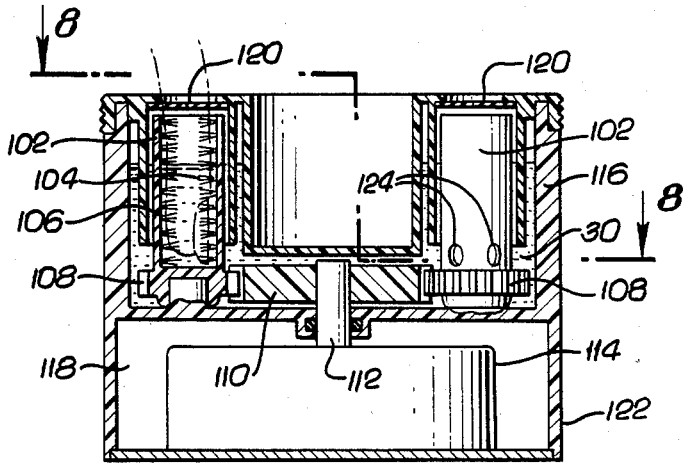
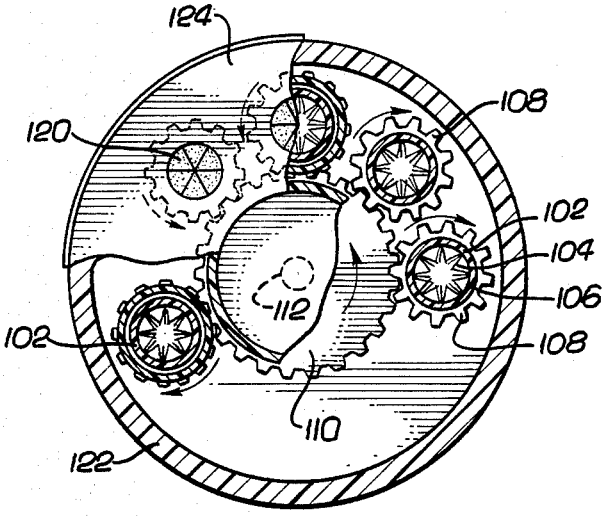
FIG. 8

APPARATUS AND METHOD FOR AUTOMATICALLY REMOVING FINGERNAIL POLISH

BACKGROUND OF THE INVENTION

1. Field of the Invention

This invention relates to the field of apparatus and methods for removing fingernail polish from fingernails.

2. Prior Art

In one method in widespread use for removing fingernail polish from fingernails, a person wets a piece of cotton, typically a cottonball, with fingernail polish removing fluid and then rubs the fingernail with the wetted cotton until the fingernail polish has been removed. The approximate amount of time to remove the fingernail polish from the fingers of both hands might be in the range of 10 to 15 minutes using this process. In addition to the amount of time required, a number of other disadvantages are associated with this method. Because the fingernail polish removing fluid is a chemical (acetone is an important ingredient in many fingernail polish removing fluids), a danger exists that the fingernail polish remover will be inadvertently dripped or spilled onto clothing, carpets, or furniture. Another disadvantage is that it is very difficult to remove the fingernail polish from only one fingernail, which might be desired in the event that a repair is to be made to one fingernail only. Typically in this situation, other fingernails, especially the fingernails of the hand holding the wetted piece of cotton, are exposed to the fingernail polish removing fluid. This often necessitates that the fingernail polish be removed and reapplied to fingernails other than the one under repair.

Another method for reportedly removing fingernail polish uses a sponge disposed in a small jar. Fingernail polish removing fluid is placed in the jar and saturates the sponge. In order to remove fingernail polish from the fingernail, the finger is supposedly inserted into a hole through the center of the sponge, rotated and then removed. Some users of this method have reported less than satisfactory results, as the side portions of the fingernails adjacent to the finger, do not have the fingernail polish completed removed therefrom, especially in the case of persons having sharply rounded fingernails.

The present invention overcomes all the disadvantages of the above-described methods of removing fingernail polish. With the apparatus for automatically removing fingernail polish of the present invention, not only can fingernail polish be removed more neatly than has heretofore been possible, especially using wetted cotton, but fingernail polish may be removed from a plurality of fingernails at one time, thereby resulting in a significant saving of time. In addition, in the event of a repair to one fingernail, it is possible, using the present invention, to remove the fingernail polish from only the fingernail to be repaired without any exposure whatsoever of the other fingers to the fingernail polish removing fluid.

SUMMARY OF THE INVENTION

An important object of the present invention is to allow the removal of fingernail polish from fingernails in less time and more neatly than has heretofore been possible. To achieve this objective, the apparatus of the present invention has the capability of simultaneously removing fingernail polish from a plurality of fingers.

In one embodiment, the present invention uses a brush having soft bristles which extend generally radially outward from a central core. The brush is located within a tank or compartment capable of containing therein fingernail polish removing fluid and is oriented so that the central core of the brush is horizontal.

This brush is rotated by an electric A.C. motor which is located in a compartment of the apparatus adjacent to the brush. A seal surrounding the shaft of the motor prevents the possibly of fingernail polish removing fluid, either in the form of a vapor or of a liquid, from entering the compartment containing the electric motor.

In the bottom of the compartment containing the brush is placed the fingernail polish removing fluid so that the bristles of the brush are partially submerged in the fluid. The present invention uses the same type of fingernail polish removing fluid as is used in the manual methods herein described for removing fingernail polish. The brush is completely enclosed by this tank or compartment except for a rectangular opening through which the fingers containing the fingernails from which fingernail polish is to be removed are inserted. In the preferred embodiment described herein, this opening is covered by a flexible diaphragm or membrane having expandable slits through which the fingers are inserted. This diaphragm seals around the fingers and contains the fingernail polish removing fluid within the compartment while the apparatus is operating.

Inside the fluid containing compartment are located small platforms upon which the fingers from which fingernail polish is to be removed are placed. These platforms position the fingernails so that they are pressed against the bristles of the brush when the fingers are inserted through the slits in the diaphragm. With the fingers so inserted into the apparatus, a push-button mercury or reed switch controlling the electric motor may be depressed to rotate the brush and to initiate the fingernail polish removing process. The brush carries the fingernail polish removing fluid located at the bottom of the fluid containing compartment around the compartment on the bristles of the brush and brushes it over the fingernails, removing the fingernail polish in a matter of seconds. The push-button is subsequently released and, after the brush has stopped rotating, the fingers are removed from the apparatus, the fingernail polish removing procedure having been completed with respect to those fingers.

It will be appreciated that with the present invention there is no danger of accidentally dripping or spilling fingernail polish removing fluid on clothes, carpets or furniture as the fluid is contained within the fluid containing compartment and is not handled during the fingernail polish removing procedure. Since it is not necessary to handle the fingernail polish removing fluid during the procedure, fingernail polish may be removed from one finger only without exposing the other fingers to fingernail polish removing fluid, as might be desired during the course of a repair to a fingernail.

In a second embodiment of the present invention, a plurality of brushes each having bristles projecting generally radially inward from a cylindrical surface is used. A secondary gear wheel is attached concentrically to each cylindrical brush and interacts with a primary gear wheel which is rotated by a motor, the plurality of brushes thereby rotating simultaneously when the motor is activated. The brushes are positioned relative to one another so that a different finger of one hand may be inserted within each brush. One or more fluid containing compartments surrounds the brushes, so that at least the bristles of each brush nearest to the bottom are saturated by the fingernail polish removing fluid placed therein. As the brushes rotate, the saturated bristles brush across the fingernails, removing the fingernail polish.

BRIEF DESCRIPTION OF THE DRAWINGS

FIG. 5 is a cross-sectional view of the first preferred embodiment of the present invention taken along the lines 5—5 in FIG. 2.

FIG. 6 is a perspective view of a second preferred embodiment of the present invention.

FIG. 7 is a cross-sectional view of the second preferred embodiment of the present invention taken along the lines 7—7 in FIG. 6.

FIG. 8 is a cross-sectional view of the present invention, partially cut away, taken along the lines 8—8 in FIG. 7.

DESCRIPTION OF THE INVENTION

The present invention will first be described in terms of a first preferred embodiment which is capable of removing fingernail polish from one or more fingers neatly and efficiently. In this embodiment, the fingernail polish is removed from the fingernails by a rotating brush having soft bristles extending radially outward from a central core, which bristles have been saturated with fingernail polish removing fluid. An electric motor located in a compartment adjacent to the fluid containing compartment but isolated from it for safety reasons rotates the brush about the axis along the core of the brush. The fingers from which fingernail polish is to be removed are placed into the fluid containing compartment through an aperture near the top of the compartment and rest on platforms situated therein so that the fingernails are pressed against the bristles of the brush. A flexible diaphragm having expandable slits through which the fingers are placed covers the aperture and seals around the fingers so that the fingernail polish removing fluid is contained within the fluid containing compartment during operation.

The fingernail polish removing fluid which is used with the apparatus of the present invention may be identical to the fingernail polish removing fluid typically used with respect to the other methods for removing fingernail polish heretofore described. A small amount of this fingernail polish removing fluid is placed in the fluid containing compartment so that the bristles of the brush are submerged partially in the fluid. As the brush rotates, the fingernail polish removing fluid is carried by the bristles of the brush and brushed against the fingernails. The fingernails are positioned in a substantially vertical plane on the platforms so that when the brush rotates, the bristles brush along the length of the fingernails as they travel downward or toward the tips of the fingers. In the preferred embodiment, the brush rotates at least several hundred revolutions per minute so that in a very short time the wetted bristles have completely removed the fingernail polish from the fingernails being processed.

Figure 1:
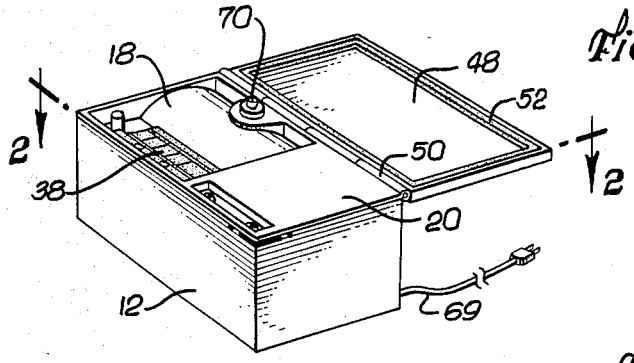
FIG. 1 is a perspective view of a first preferred embodiment of the present invention.

A perspective, view of the first preferred embodiment of the present invention is shown in FIG. 1. A more detailed description of the present invention will now be given with references to FIGS. 2 through 5. The housing 12, which contains the other components of the present invention may be fabricated from plastic or other material having sufficient rigidity and imperviousness to fingernail polish removing fluids. The two main compartments of the housing 12 are the fluid containing compartment 18 and the motor compartment 20, as can be seen most clearly in FIG. 2.

Figure 2:
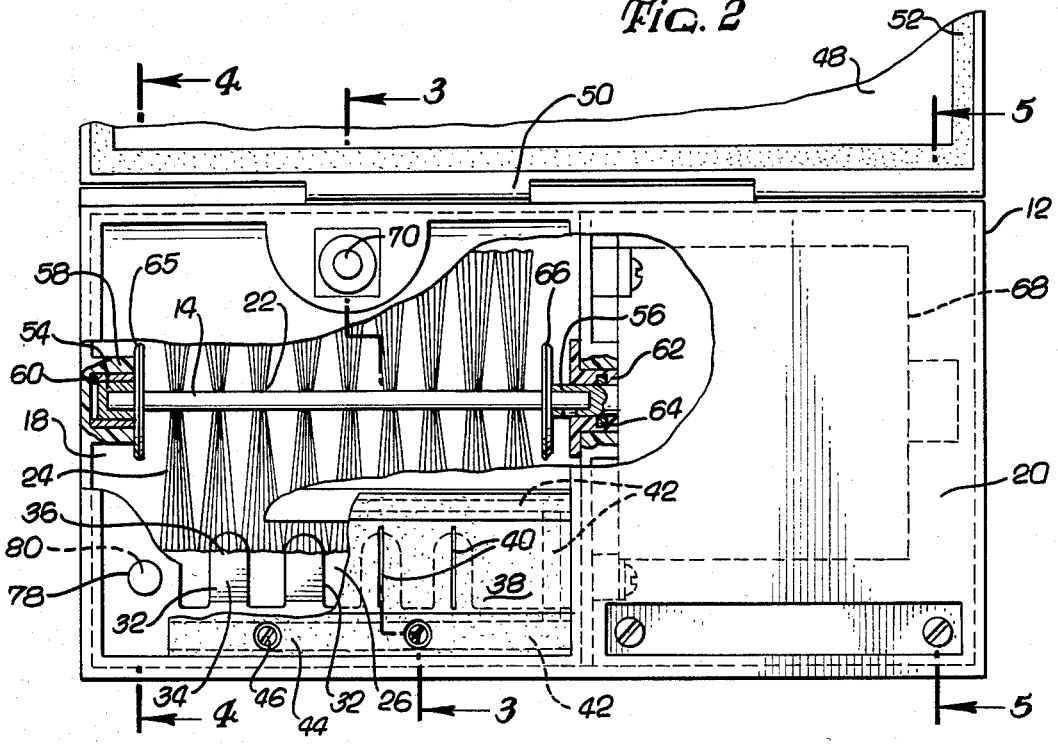
FIG. 2 is a sectional view of the first preferred embodiment of the present invention, partially cut away, taken along the lines 2—2 in FIG. 1.

As shown in FIG. 2, the fluid containing compartment or tank 18 contains a cylindrically shaped brush 22 having bristles 24 extending radially outward from an axis or central core 14 about which the brush 22 may be rotated. In the preferred embodiment, the brush 22 is a spiral wound brush, sometimes referred to as a "twisted in wire" brush having soft nylon bristles.

Brushes of various diameters and having bristles of various diameters are suitable for use in the present invention. The selection of a particular brush 22 depends in part on the speed with which the brush 22 is to be rotated. It has been found, for example, that a brush having a 3.00 inch diameter and bristles of 0.012 inches in diameter provides satisfactory results when rotated at speeds between 600 and 1500 revolutions per minute (rpm). As another example, satisfactory results have been obtained with a brush of the same diameter having bristles 0.008 to 0.010 inches in diameter when rotated at speeds of between 1400 and 1550 rpm. The present invention, however, is in no way limited to brushes having these particular specifications or rotating at those indicated speeds.

The fluid containing compartment or tank 18 is formed principally by the housing 12 and is fluidtight except in the area of the opening 26. As can be seen most clearly in FIG. 3, part of the surface of the fluid containing compartment or tank 18 is cylindrically shaped and partially surrounds the brush 22. The bottom of the fluid containing compartment or tank 18 is located close to the brush 22 so that the bristles 24 of the brush 22 are submerged in fingernail polish removing fluid 30 which is placed in the fluid containing compartment or tank 18.

The edge of the fluid containing compartment or tank 18 adjacent to the opening 26 above the brush 22 has a small downwardly protruding lip 28 which runs the entire length of the opening 26. This directs the fingernail polish removing fluid 30, which is thrown against the cylindrical portion of the fluid containing compartment or tank 18 when the brush 22 rotates counterclockwise as viewed in FIG. 3, downward and away from the opening 26 thereby helping to insure that fingernail polish removing fluid 30 remains within the fluid containing compartment or tank 18.

Extending downward from the top of the fluid containing compartment or tank 18 on the side of the opening 26 opposite the lip 28 and brush 22 are finger positioning platforms 32. Finger positioning platforms 32 are comprised of straight narrow members 34 which extend downward from the edge of the opening 26 into the fluid containing compartment or tank 18 toward the brush 22 and a small lip 36 at the end thereof protruding toward the brush 22.

Figure 3:
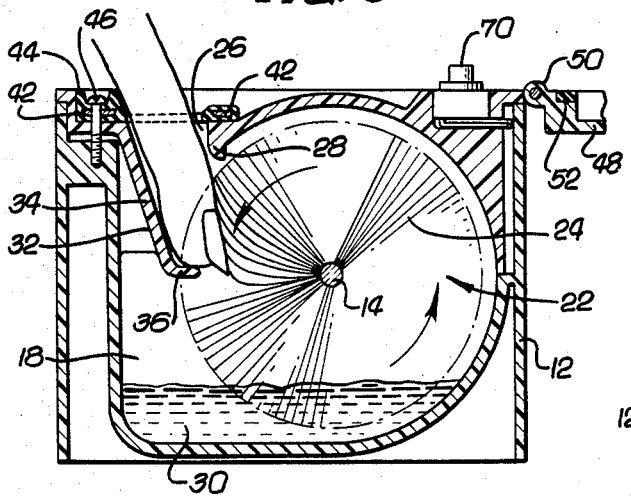
FIG. 3 is a cross-sectional view of the first preferred embodiment of the present invention taken along the lines 3—3 in FIG. 2.
Figure 4:
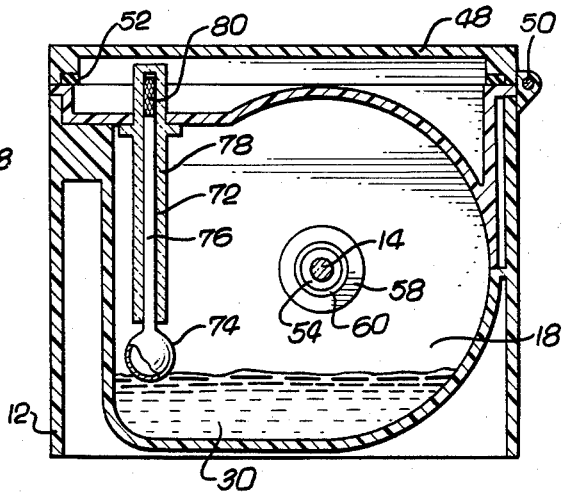
FIG. 4 is a cross-sectional view of the first preferred embodiment of the present invention taken along the lines 4—4 in FIG. 2.

In use, the front of a finger having a fingernail from which fingernail polish is to be removed is placed against the straight member 34 with the tip of the finger resting on the lip 36, as shown in FIG. 3. With the finger so positioned, the fingernail is pressed against the bristles 24 of the brush 22. In the preferred embodiment described herein, there are four finger positioning platforms 32 so that fingernail polish may be simultaneously removed from as many as four fingernails.

The opening 26 in the fluid containing compartment 18 is covered by a diaphragm 38. Diaphragm 38 is a thin, soft, flexible membrane formed of stretchable material, the primary purpose of which is to prevent fingernail polish removing fluid from exiting the fluid containing compartment or tank 18 while the present invention is being used and brush 22 is rotating. Diaphragm 38 has four small holes or slits 40 corresponding to and located above the finger positioning platforms 32. Fingers may be inserted into the fluid containing compartment or tank 18 through the slits 40. When fingers are not inserted into the slits 40, the slits 40 remain closed to prevent the escape of fingernail polish removing fluid. Because the diaphragm 38 is composed of a flexible material, however, it stretches to accommodate a finger inserted into a slit 40 and forms a seal around the finger. Diaphragm 38, therefore, effectively seals the fluid containing compartment or tank 18 whether or not one or more fingers are inserted through the slits 40.

In the preferred embodiment described herein, diaphragm 38 is fabricated from a sheet of soft hyplon rubber type or polypropylene type material having a thickness of 0.010 to 0.050 inches. In the preferred embodiment described herein, a flat stiffening member 42 is molded into the diaphragm 38 when it is fabricated. Stiffening member 42 extends around the periphery of the diaphragm 38 above the upper edges of the opening 26. This permits the diaphragm 38 to be attached to the top of the fluid containing compartment or tank 18 by screws 46 extending through a thicker portion 44 of the diaphragm 38 on only one side of the opening 26. The other three sides of the diaphragm 38 are pressed against the upper edge of the fluid containing compartment or tank 18 around the opening 26 due to the stiffness of the member 42. It will be recognized by those skilled in the art that other methods for covering the opening 26 to seal fingernail polish removing fluid therein, whether one or more fingers are inserted into the fluid containing compartment or tank 18 or not, are possible and may advantageously used with the present invention.

The diaphragm 38 is not intended to seal against the leakage of fingernail polish removing fluid from the fluid containing compartment or tank 18 should the apparatus of the present invention be turned over during the course of being transported from one place to another. For this purpose, and also to prevent any possible evaporation of the fingernail polish removing fluid when the apparatus is not in use, the fluid containing compartment or tank 18 is provided with a lid 48 attached to the top of the fluid containing compartment or tank 18 by means of hinges 50. A seal 52 between the top edge of the fluid containing compartment or tank 18 and the lid 48 prevents the leakage of fingernail polish removing fluid from the apparatus when the lid is closed and fastened by a closure means, suitable ones of which are well-known in the art.

The first preferred embodiment of the present invention has a gauge 72 for monitoring the level of fingernail polish removing fluid 30 in the fluid containing compartment or tank 18. Gauge 72 comprises a float 74 floating in the fluid 30 and attached to a cylindrical rod 76. Float 74 and cylindrical rod 76 move vertically in response to the level of fluid 30 in the fluid containing compartment or tank 18, cylindrical rod 76 sliding in a hollow transparent cylindrical guide 78. So long as the level of fluid 30 in the fluid containing compartment or tank 18 is sufficient for operation of the apparatus, the upper end 80 of cylindrical rod 76 is visible through the upper end of cylindrical guide 78. To enhance the visibility of the upper end 80 of cylindrical rod 76, it is preferably a bright color, such as red. If the level of fluid 30 has decreased to the point where more fluid should be added before operation, the float 74 and cylindrical rod 76 more downward. The upper end 80 of cylindrical rod 76 is then no longer clearly visible through the cylindrical guide 78, and the apparatus should not be operated until more fluid 30 is added.

In the preferred embodiment described herein, the ends of the central core 14 of the brush 22 are mounted in oil impregnated bushings 54 and 56 by set screws. The housing 12 of the apparatus has a thickened portion or boss 58 having a circular opening therein in which is mounted a cylindrical oil impregnated bushing 60 into which bushing 54 fits. The part of the housing 12 between the motor compartment 20 and fluid containing compartment or tank 18 contains a circular opening in which is mounted a cylindrical oil impregnated bushing 62 which accommodates the oil impregnated bushing 56. A Teflon O-ring seal 64 is disposed around the bushing 56 and bears against the bushing 60 in order to effectively seal the motor compartment 20 from fingernail polish removing fluid 30 located in the fluid containing compartment or tank 18. Fluid slingers 65 and 66 are mounted on the shaft of the brush 22 adjacent to the oil impregnated bushings 54 and 56. These fluid slingers 65 and 66 are disk-like members which assist in keeping fingernail polish removing fluid 30 away from the oil impregnated bushings 54, 56, 58 and 60 thereby help to insure that fingernail polish removing fluid 30 does not leak out of the fluid containing compartment or tank 18 while the brush 22 is rotating.

An electric motor 68 is mounted in the motor compartment 20 adjacent to the fluid containing compartment or tank 18. Motor 68 has a shaft which is oriented along the axis or central core 14 of the brush 22 and is attached to bushing 54 so that the rotation of the shaft of motor 68 causes the brush 22 to rotate. In the preferred embodiment, the electric motor is an a.c. motor provided with a cord 69, so that the present invention may be operated using standard house current. An a.c. motor is preferred over a d.c. motor because of the combustibility of fingernail polish removing fluid and the presence of sparks generated by a d.c. motor.

The electric motor 68 is controlled by a push-button switch 70 shown in FIGS. 2 and 3. Push-button switch 70 is, preferably, a reed or mercury switch, since either of these types of switches do not produce sparking. As a safety precaution, push-button switch 70 activates the electric motor 68 only when pressed. When push-button switch 70 is released, electric motor 68 is turned off and brush 22 stops rotating. This insures that the apparatus of the present invention will not inadvertently be left turned on.

In operation, one or more fingers having fingernail from which fingernail polish is to be removed are inserted into the fluid containing compartment or tank 18 of the apparatus of the present invention through the slits 40 in the diaphragm 38 covering the opening 26. The fingers are positioned on the finger positioning platforms 32 so that the fronts of the fingers are resting on the members 34 with the tips touching the lips 36. In this position, the fingernails are pressing against the bristles 24 of the brush 22. The slits 40 of the diaphragm 38 seal around the fingers to prevent fingernail polish removing fluid from splashing out of the fluid containing compartment or tank 18 when the apparatus is activated. With the fingers so inserted, the push-button switch 70 may be pressed starting the electric motor 68. The bristles 24 of the brush 22 carry fingernail polish removing fluid 30 in the bottom of the fluid containing compartment or tank 18 as brush 22 rotates, the bristles 24 thereby brushing the fluid 30 against the fingernails. This action removes the fingernail polish from the fingernails as well as imparts a pleasant sensation to the fingertips. After a short period of time, the push-button switch 70 is released so that the electric motor 68 is switched off and the brush 22 stops rotating. The fingers may then be withdrawn through the slits 40 from the fluid containing compartment or tank 18 as they are now free of fingernail polish.

An alternate embodiment of the present invention is shown in FIGS. 6 through 8. In this embodiment, a different brush 102 is used to remove the fingernail polish from each finger. The brushes 102 have bristles 104 which radiate generally inwardly from a cylindrical surface 106. Each brush 102 is sized to accommodate a single finger inserted into the area bounded by the cylindrical surface 106.

The brushes 102 are placed within a fluid containing compartment or tank 116, with the fluid 30 having access to the area of the brush 102 bounded by the cylindrical surface 106 through openings 124. When brushes 102 are rotated, the bristles 104 of brushes 102 brush the fingernail polish removing fluid across the fingernails thereby removing the fingernail polish. Sectioned diaphragms 120 formed of a flexible material above each cylindrical brush 102 assist in keeping the fluid 30 in the fluid containing compartment or tank 30 while the brushes are rotating whether or not a finger is inserted through the center of the diaphragm 120.

In the alternate embodiment shown in FIGS. 6 through 8, a plurality of brushes 102 is used. Mounted at the base of each brush 102 or formed integrally with it is a secondary gear wheel 108. The teeth of the secondary gear wheels 108 are engaged by the teeth of a primary gear wheel 110. Primary gear wheel 110 is mounted on a shaft 112 of an electric motor 114 located in motor compartment 118 so that when the electric motor 114 is activated, each of the brushes 102 rotates. With this alternate embodiment, one or more than one brush 102 may be used in order to provide either single finger or multiple finger capability.

A cylindrical housing 122 contains the above-described components and is provided with a cover 126 which may be screwed on to prevent the evaporation or loss of fluid when not in use or during transportation.

While the present invention has been described in terms of a preferred embodiment and in terms of an alternate embodiment, it will be appreciated that the present invention is not so limited to those described configurations.

I claim:

1. A device for removing fingernail polish simultaneously from a plurality of fingernails using fingernail polish removing fluid comprising:

a housing having a fluid compartment and a motor compartment, said fluid compartment receiving nail polish removing fluid;

a generally-cylindrical rotatable brush having a central core and a periphery, said brush being mounted with its axis disposed horizontally in the fluid compartment, said periphery being positionable in the polish removing fluid during rotation of the brush to wet said periphery with the fluid;

a motor mounted in the motor compartment and having a shaft connected to the central core of the brush so as to rotate the brush about its axis when the motor is energized;

means sealing the two compartments from one another so that polish removing fluid in the fluid compartment cannot leak into the motor compartment;

a top wall in part defining the fluid compartment and having an elongated opening therein parallel to the brush axis and aligned vertically with the periphery of the brush;

finger-positioning platforms extending downwardly from the top wall adjacent the side of the opening remote from the brush axis for positioning the fingernails of fingers inserted through the opening in a substantially vertical plane so that the wetted periphery of the brush brushes along the length of the fingernails and so that the inserted fingers are not immersed in the fluid;

said motor rotating in a direction so that the periphery of the brush moves generally downwardly with respect to the platforms; and a finger-penetratable flexible member mounted on the top wall and covering the elongated opening for closing around the fingers when the fingers are inserted through the opening onto the platform and preventing polish removing fluid in the fluid compartment from splashing out of the fluid compartment through the opening.

2. A device as defined in claim 1 further characterized by said fluid compartment being configured so as to lie in close proximity to the periphery of the brush about a substantial portion of the brush circumference including adjacent the top wall;

and a downwardly-extending lip on said top wall adjacent the side of the opening closer to the brush axis for preventing polish removing fluid in the fluid compartment from impinging against the flexible member.

3. A device as defined in claim 1 further characterized by means including a switch mounted on the top wall for controlling the motor.

4. A device as defined in claim 3 further characterized by said switch being a push-button switch which when released turns off the motor.

5. A device as defined in claim 1 further characterized by said flexible member being made of sheet rubber and slits being provided in the rubber sheet through which the fingers may be inserted.

6. A device as defined in claim 4 further characterized by a gauge in the fluid compartment for monitoring the level of polish removing fluid in the fluid compartment.

* * * * *